United States Patent [19]

Hansal

[11] Patent Number: 4,989,915

[45] Date of Patent: Feb. 5, 1991

[54] SEATING ELEMENT FOR ARRANGEMENT IN ROWS

[76] Inventor: Werner Hansal, Rehteichweg 13, 7506 Bad Herrenalb, Fed. Rep. of Germany

[21] Appl. No.: 370,748

[22] Filed: Jun. 20, 1989

[30] Foreign Application Priority Data

Nov. 9, 1988 [DE] Fed. Rep. of Germany ..... 3837914

[51] Int. Cl.[5] ..... B60N 2/02

[52] U.S. Cl. ..... 297/378; 297/232; 297/17

[58] Field of Search ..... 297/378, 232, 352, 118, 297/380, 354, 335, 292, 300, 17, 379, 180

[56] References Cited

U.S. PATENT DOCUMENTS

| | | | |
|---|---|---|---|
| D. 183,233 | 7/1958 | Ahrens | 297/378 X |
| 878,889 | 2/1908 | Miller | 297/378 X |
| 1,515,564 | 11/1924 | Field | 297/378 X |
| 2,233,939 | 2/1966 | Chapman | 297/232 X |
| 2,536,157 | 1/1951 | Campanelli | 297/378 X |
| 2,974,321 | 3/1961 | Salka | 297/17 X |
| 3,316,013 | 4/1967 | Abel et al. | 297/232 X |
| 3,635,521 | 1/1972 | Shivvers | 297/378 X |
| 4,632,452 | 12/1986 | Vogel | 297/378 X |
| 4,746,166 | 5/1988 | Sadan | 297/17 |
| 4,779,927 | 10/1988 | Trutter et al. | 297/379 |
| 4,850,159 | 7/1989 | Connor | 297/378 X |

FOREIGN PATENT DOCUMENTS

| | | | |
|---|---|---|---|
| 0012764 | 3/1979 | European Pat. Off. . | |
| 3614983 | 2/1986 | Fed. Rep. of Germany . | |
| 19076 | of 1914 | United Kingdom | 297/378 |

*Primary Examiner*—José V. Chen

*Attorney, Agent, or Firm*—Wenderoth, Lind & Ponack

[57] ABSTRACT

A seating element adapted to be arranged in rows of like seating elements for seating in halls, stadiums, stands, etc., consists of a seat section, which may be mounted to a support structure by way of a joint row attachment device, and a back-rest section movably linked to the seat section such that it can be laid down on the seat section in a covering position. The back-rest section is attached to the seat section in such a way that it falls back automatically into the covering position in the absence of counter lifting forces and rests on the seat section. This arrangement is compact, prevents the seat back-rests from being obstructions which would hamper evacuation in a panic situation, and is readily cleanable.

13 Claims, 2 Drawing Sheets

SEATING ELEMENT FOR ARRANGEMENT IN ROWS

BACKGROUND OF THE INVENTION

The invention concerns a seating element adapted to be arranged in rows of identical seating elements for seating in halls, stadiums, stands, etc. The seating element consists of a seat section, which may be connected, if appropriate, to a joint row attachment device, and of a back-rest section, movably linked to the seat section such that it can be laid down on the seat section in a covering position.

Various embodiments of seating elements which can be arranged in rows are known for seating in halls, stands, etc. DE-OS No. 36 14 983 describes seating elements of this type, where the back-rest section can be laid down on the seat section. The seating elements are mounted to a telescoping stand which comprises step units with seat or tread surfaces that can be moved horizontally in a telescoping fashion. The arrangement is such that when the telescoping stand is pushed together the upright back-rest sections are forced down on to the seat sections, so that there is no obstruction to the telescoping action of the stand. These back-rest sections must be opened up manually into the user position when the seat is to be used.

Thus, in the known embodiments, it is necessary to move the back-rest section down to cover the seat section either by hand or by other appropriate means such as a telescoping stand which is pushed together. The upright back-rest sections, which remain in the user position unless they are lowered by some external intervention, obstruct the necessary cleaning work throughout the rows by seats and may constitute an obstacle which would block possible escape routes in the event of panic.

SUMMARY OF THE INVENTION

The objective of the invention is to design seating elements as described above, which will allow the stand to be easily cleaned when not in use and in which the projecting back-rest sections do not constitute an obstruction to escape routes in the event that the users stand up suddenly in a panic situation. This is achieved by the invention because the back-rest section is attached to the seat section in such a way that it falls back onto the seat section into the covering position automatically in the absence of an external lifting force. A design of this type, which can be technically achieved in a variety of ways, provides that the back-rest section always rests on the seat section in the absence of a lifting force by the user, and thus neither impedes cleaning work with unwieldy projections nor blocks potential escape routes. The automatic folding action of the back-rest section may, if appropriate, be advantageously delayed by means of a suitable compensating device.

One practical embodiment may provide for at least one spring element to be connected between the seat section and the back-rest section in such a way that it forces the back-rest section into the covering position. Other structural elements providing elastic pre-loading or weight-loaded elements may be located on the back-rest section instead of spring elements. A practical design may provide for the back-rest section to be connected to the seat section with laterally spaced brackets and swivel trunnion bearings, and for a spring element to be provided in the vicinity of these swivel trunnion bearings. The spring element is preferably designed to be supported on one supporting surface of the lateral brackets.

A further advantage can be achieved, where appropriate, by designing the back-rest section such that, when it rests on the seat section in the covering position, its external surface forms a smooth surface for the folded seating element. This facilitates cleaning of the seating rows and in the case of seating elements which are exposed to the weather, the back-rest section protects the seat-section against the weather and against ultraviolet radiation. The back-rest section may also have an external surface which is metal coated or provided with metal cladding to forma protection for the seat section, which may, for example, be designed as a mounded plastic part. The seating element may also be designed to include sealing elements which form a seal between the seat and back-rest surfaces when in the covering position. In one preferred embodiment, a plurality of the seating elements may be closely connected together such that, in the covering position, the upper surfaces of a plurality of back-rest sections form an essentially continuous standing surface for the row, and such that, in the use position, there is a continuous seating bench formed.

Although individual mounting of the seating elements, by way of legs for example, is possible, in general it is more useful to design the seating section with one continuous mounting element for connecting several adjacent seat sections to a support surface. The arrangement is preferably such that the connection elements of the seat sections can be detached from and tightened to such a continuous mounting element from the front of the seat section. The continuous mounting element may, for example, comprise a continuous hollow beam. A mounting design of this type permits simple, time-saving replacement of damaged seating elements.

Each of the seat sections and the back-rest sections are advantageously formed of a single moulded plastic element. It may, however, be appropriate to form them of metal, e.g. aluminum or steel, depending on the intended purpose and the location.

When the seating elements are used in connection with stands exposed to the weather, it may be useful to form access and drainage recesses on the seat section and/or back-rest section, such that when the seat section is raised water can drain off.

A preferred embodiment may provide for the length of the back-rest section to be proportioned in relation to the length of the seat section such that, in the covering position, the front of the back-rest section rests flush with the front of the seat section. Together with the closely connected arrangement of the seating elements in a row, as described above, this automatically creates a compact arrangement when the stand is not in use, which is protected against weathering and is readily cleanable.

BRIEF DESCRIPTION OF THE DRAWINGS

Other characteristic features of the invention are shown in the embodiment illustrated, in which.

DETAILED DESCRIPTION OF THE INVENTION

Figure 1:
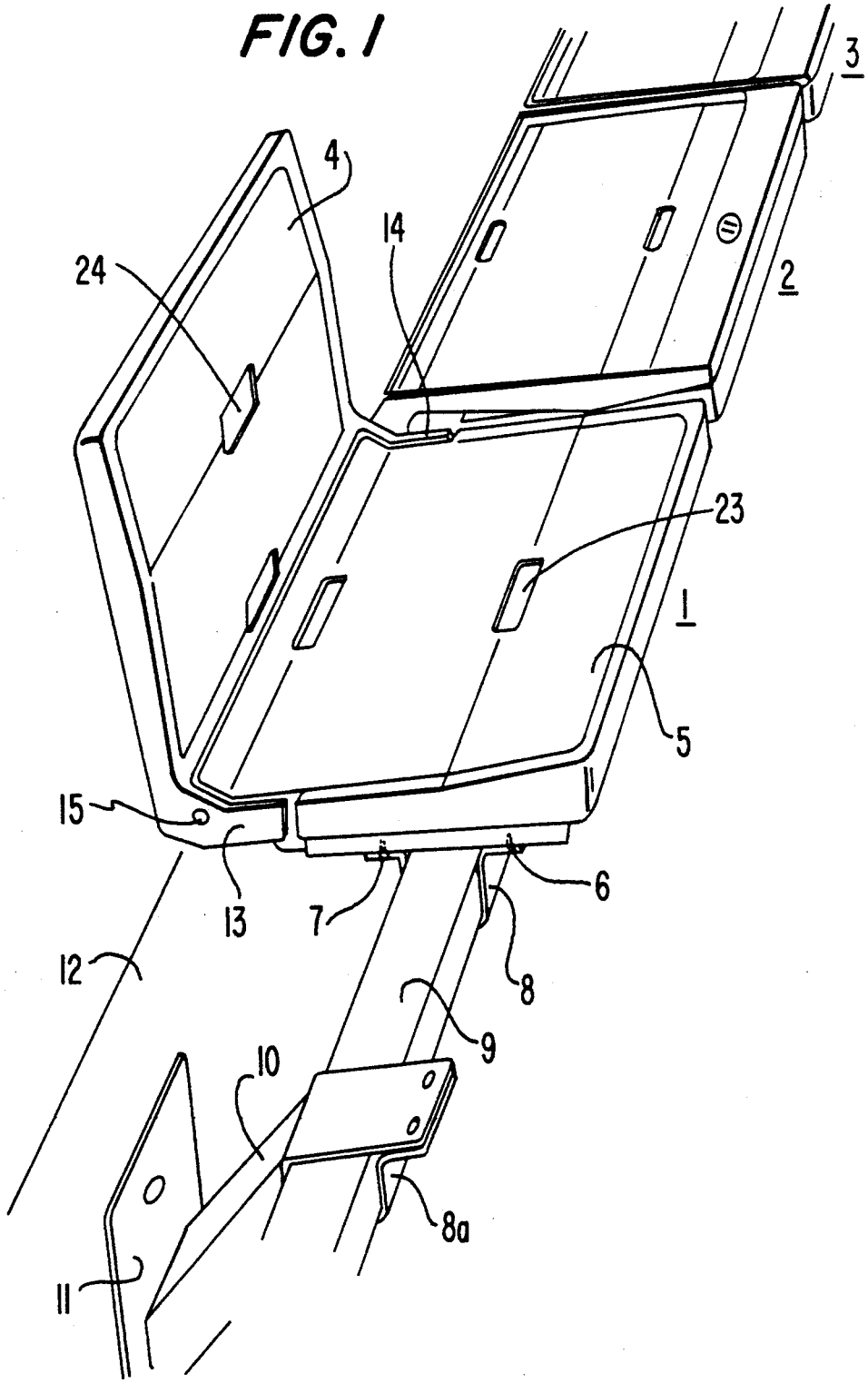
FIG. 1 shows an isometric view of an arrangement of seating elements in a row, with seating elements in both the use position and the covering position.

FIG. 1 shows an arrangement of seating elements 1, 2 and 3 in a row. Each seating element consists of a back-rest section 4 and a seat section 5. The back-rest section 4 automatically rests on the seat section 5 in the absence of lifting forces, as shown in the case of seating elements 2 and 3. The seat section 5 is connected with screws 6, 7 through a holding bracket 8 to a support beam 9 which is located continuously along the row of seats.

A similar holding bracket 8*a* is shown in FIG. 1 in front of seating element 1. The bracket 8*a* includes an additional connection to a support stay 10 which is attached via a fastening plate 11 to the vertical side of a stair 12. This additional attachment can be used when the rows of seating elements are arranged in steps.

Figure 3:
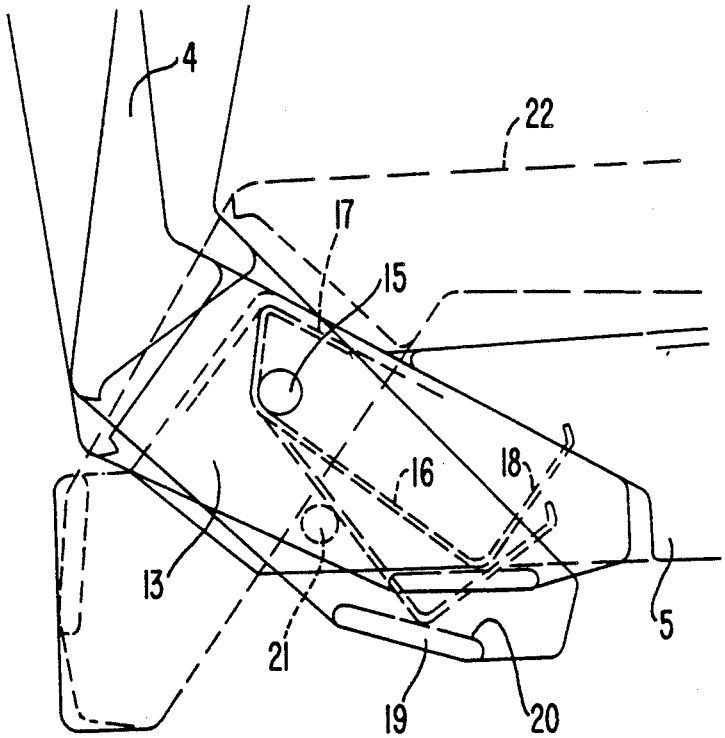
FIG. 3 shows an enlarged detailed view of a portion of the seating element shown in FIG. 2.
Figure 2:
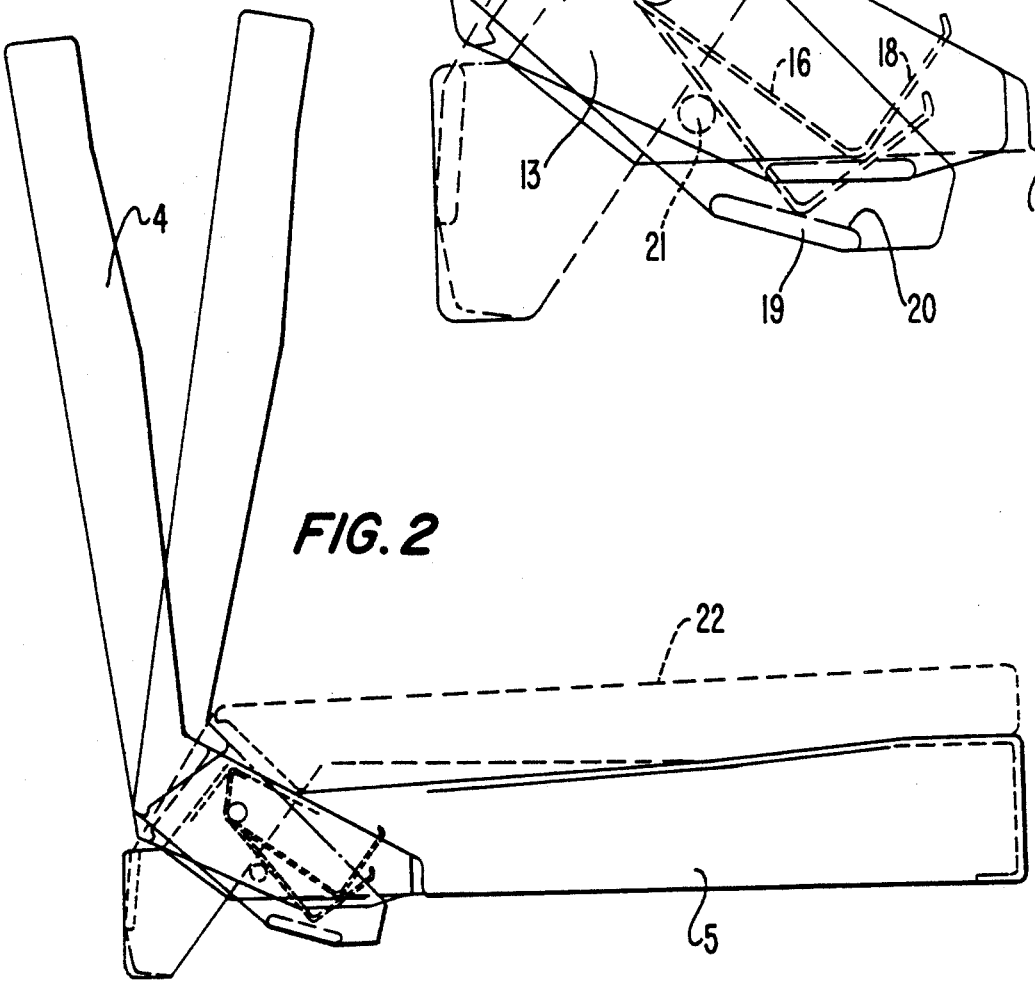
FIG. 2 shows a partial section of a side view of one of the seating elements in FIG. 1.

The back-rest section 4 is fastened with swivel trunnion bearings 15 to both sides of the seat section 5 by way of brackets 13, 14 which are moulded unitarily with the sides of the back-rest section 4. The details of the swivel trunnion bearing mounting 15 can be seen clearly in FIGS. 2 and 3.

To cause the back-rest section 4 to rest automatically on the seat section 5, a bracket spring 16 surrounds each of the pivot trunnion bearings 15. One end piece 17 of the spring 16 is mounted on the seat section 5 and the other end piece 18 of the spring 16 bears against a support piece 19 moulded on to bracket 13 so as to form a support surface 20. A vertical journal 21 is provided on seat section 5 near the bracket spring 16, which is about 1 cm wide for seats of normal size, for the purpose of providing pre-loading to the spring 16.

When the seating element folds together, bracket spring 16 only acts until the center of gravity of the back-rest section 4 has been moved past its dead center position. The back-rest section 4 then falls forward under its own weight on to seat section 5 and rests in the covering position. When the user raises the back-rest section 4, he must first overcome gravity but no counter spring action. When the dead center position is reached, the pre-loading of the spring takes effect. The back-rest section 4 then remains in the use position as long as a force is present to counteract the slight pre-loading of the spring. When the user stands up, the spring action of spring backet 16 again moves the back-rest section 4 past the dead center position so that the back-rest section 4 is laid on and supported by the upper side of the seat section 5 as a result of gravity.

In the covering position, the external side 22 of the back-rest section 4 may form a continuous standing surface if several seating elements 1, 2, 3 are arranged adjacent to one another in a row.

Each of the seat sections 5 and the back-rest sections 4 are preferably moulded as one-piece plastic elements, and the external side 22 of each of the back-rest sections 4 may have a metallic coating or metal surface cladding in appropriate circumstances.

In order to further weatherproof the seating elements, the seat sections and back-rest sections are arranged so as to form a sealing means and create a seal between the seat section 5 and the back-rest section 4 when the back-rest section is in its covering position.

I claim:

1. A seating element for use in row-type seating arrangements, comprising:

a seat section adapted to be mounted approximately horizontally to a support element;

a back-rest section pivotally mounted to said seat section for movement between a use position in which said back-rest section extends upwardly from said seat section and a covering position in which said back-rest section extends in approximately horizontal covering relation over said seat section;

first and second pivot pins respectively connected to said seat section along a common pivot axis at a rearward end of each side of said seat section;

first and second brackets respectively extending from each side of said bracket section, each of said first and second brackets having an opening therein which receives a respective one of said first and second pivot pins such that said back-rest section is pivotal relative to said seat section; and pivoting means for automatically pivoting said back-rest section about said common pivot axis from said use position to said covering position in the absence of a force holding said back-rest section in said use position, said pivoting means comprising a spring element mounted between and bearing against both said seat section and said backrest section, and means, mounted between said back-rest section and said seat section, for introducing a pivoting force against said back-rest section when said back-rest section is in said use position to cause pivoting of said back-rest section toward said covering position, and for releasing said pivoting force from against said back-rest section after said back-rest section has pivoted to a point where its center of gravity has moved past its top-dead-center position such that gravity will cause said back-rest section to pivot further and into said covering position.

2. A seating element as recited in claim 1, wherein said spring element has first and second ends and a midportion;

at least one of said first and second brackets has a flange protruding laterally therefrom;

said first end of said spring element bears against said flange at least when said back-rest section is in said use position;

said midportion of said spring element bears against one of said first and second pivot pins; and said second end of said spring element bears against a portion of said seat section.

3. A seating element as recited in claim 2, further comprising means, connected to said seat section, for bearing against and pre-loading said spring element at least when said back-rest section is in said covering position such that said first end of said spring bears against said flange and biases said back-rest section toward said covering position when said back-rest section is in said use position but not when said back-rest section is in said covering position.

4. A seating element as recited in claim 1, wherein said seat section is formed as a unitary molded element; and said back-rest section is formed as a unitary molded element.

5. A seating element as recited in claim 1, wherein at least one of said seat section and said back-rest section is formed at least partially of metal.

6. A seating arrangement, comprising:

a plurality of seating elements, each seating element comprising a seat section, a back-rest section pivotally mounted to said seat section for movement between a use position in which said back-rest section extends upwardly from said seat section and a covering position in which said back-rest section extends in approximately horizontal relation over said seat section, pivoting means for automatically pivoting said back-rest section from said use position to said covering position in the absence of a force holding said back-rest section in said use position, said pivoting means comprising means, mounted between said back-rest section and said seat section, for introducing a pivoting force against said back-rest section when said back-rest section is in said use position to cause pivoting of said back-rest section toward said covering position, and for releasing said pivoting force from against said back-rest section after said back-rest section has pivoted to a point where its center of gravity has moved past its top-dead-center position such that gravity will cause said back-rest section to pivot further and into said covering position;

a support element; and means for mounting each of said plurality of seating elements to said support element.

7. A seating arrangement as recited in claim 6, wherein said support element comprises a single elongated structural beam.

8. A seating arrangement as recited in claim 7, wherein said mounting means comprises a plurality of U-shaped brackets, each U-shaped bracket surrounding said structural beam, opening toward a corresponding seat section and having flanges extending outwardly from the open end of said U-shaped bracket, and fastening means for fastening each of said flanges to said corresponding seat section.

9. A seating arrangement as recited in claim 8, wherein said structural beam is positioned beneath said plurality of seating elements.

10. A seating arrangement as recited in claim 6, wherein each of said plurality of seating elements has a front face aligned with front faces of each remaining one of said plurality of seating elements.

11. A seating arrangement as recited in claim 6, wherein said seating elements are mounted in close proximity to one another, and said back-rest sections, when in their respective covering positions, form a substantially flat surface along said plurality of seating elements.

12. A seating arrangement as recited in claim 6, wherein said pivoting means comprises a spring element mounted between and bearing against both said seat section and said backrest section.

13. A seating element for use in row-type seating arrangements, comprising:

a seat section adapted to be mounted approximately horizontally to a support element;

a back-rest section pivotally mounted to said seat section for movement between a use position in which said back-rest section extends upwardly from said seat section and a covering position in which said back-rest section extends in approximately horizontal covering relation over said seat section; and pivoting means for automatically pivoting said back-rest section from said use position to said covering position in the absence of a force holding said back-rest section in said use position, said pivoting means comprising means, mounted between said back-rest section and said seat section, for introducing a pivoting force against said back-rest section when said back-rest section is in said use position to cause pivoting of said back-rest section toward said covering position, and for releasing said pivoting force from against said back-rest section after said back-rest section has pivoted to a point where its center of cavity has moved past its top-dead-center position such that gravity will cause said back-rest section to pivot further and into said covering position.

* * * * *